US008667783B2

(12) United States Patent
Naydenov et al.

(10) Patent No.: US 8,667,783 B2
(45) Date of Patent: Mar. 11, 2014

(54) METHOD AND SYSTEM FOR CONTROLLING THE OPERATION OF A PUMP

(75) Inventors: Volodia Naydenov, Louvain-la-Neuve (BE); Joel Op De Beeck, Lint (BE); Vincent Potier, Brussels (BE)

(73) Assignee: Inergy Automotive Systems Research (Societe Anonyme), Brussels (BE)

( * ) Notice: Subject to any disclaimer, the term of this patent is extended or adjusted under 35 U.S.C. 154(b) by 434 days.

(21) Appl. No.: 12/522,105

(22) PCT Filed: Jan. 16, 2008

(86) PCT No.: PCT/EP2008/050435

§ 371 (c)(1),
(2), (4) Date: Jul. 2, 2009

(87) PCT Pub. No.: WO2008/087153

PCT Pub. Date: Jul. 24, 2008

(65) Prior Publication Data

US 2010/0043409 A1 Feb. 25, 2010

(30) Foreign Application Priority Data

Jan. 19, 2007 (FR) ..... 07 00358

(51) Int. Cl.
*F01N 3/00* (2006.01)
*F04B 49/06* (2006.01)

(52) U.S. Cl.
USPC ..... 60/295; 60/287; 60/272; 417/44.2; 417/53

(58) Field of Classification Search
USPC ..... 417/42, 44.2, 53, 18, 33, 19, 20, 21, 22, 417/23, 24, 44.1, 44.11; 318/609, 610, 599, 318/811; 388/804, 811, 819; 123/497, 499, 123/198 C; 340/659; 60/286, 282, 287, 295; 700/282; 422/168; 423/212
See application file for complete search history.

(56) References Cited

U.S. PATENT DOCUMENTS 4,371,819 A * 2/1983 Kaufmann ..... 388/811
5,044,344 A * 9/1991 Tuckey et al. ..... 123/497

(Continued)

FOREIGN PATENT DOCUMENTS

DE 19809334 A1 9/1999
DE 10338996 A1 3/2005

(Continued)

OTHER PUBLICATIONS

DIN 70070:2005-08 Standard : "Diesel engines NOx•Reduction agent AUS 32 Quality requirements", Aug. 2005—in German (11 pp.).

(Continued)

*Primary Examiner* — Charles Freay
*Assistant Examiner* — Alexander Comley
(74) *Attorney, Agent, or Firm* — Oblon, Spivak, McClelland, Maier & Neustadt, L.L.P.

(57) ABSTRACT

Method for controlling the operation of a pump driven by an electric motor and controlled by a controller, according to which an electronic control module (ECM) sends, to the controller, a PWM (Pulse Width Modulation) control signal having a duty cycle that varies as a function of the desired operating conditions for the pump and according to which the controller acts on the electric motor to apply said operating conditions to the pump.

16 Claims, 1 Drawing Sheet

(56) References Cited

U.S. PATENT DOCUMENTS

| | | | | |
|---|---|---|---|---|
| 5,084,658 | A * | 1/1992 | Nielsen et al. | 318/139 |
| 5,237,975 | A | 8/1993 | Betki et al. | |
| 5,406,922 | A * | 4/1995 | Tuckey | 123/497 |
| 5,491,395 | A | 2/1996 | Hutsell | |
| 5,670,852 | A | 9/1997 | Chipperfield | |
| 5,740,783 | A * | 4/1998 | Learman et al. | 123/497 |
| 5,869,946 | A * | 2/1999 | Carobolante | 318/811 |
| 5,976,475 | A | 11/1999 | Peter-Hoblyn et al. | |
| 6,121,747 | A * | 9/2000 | Trachtenberg | 318/800 |
| 6,291,960 | B1 * | 9/2001 | Crombez | 318/599 |
| 6,661,190 | B1 * | 12/2003 | Atmur | 318/400.09 |
| 6,693,407 | B2 * | 2/2004 | Atmur | 318/811 |
| 6,700,339 | B2 * | 3/2004 | Vyssotski et al. | 318/400.26 |
| 6,861,815 | B2 * | 3/2005 | Cho et al. | 318/599 |
| 6,930,458 | B2 * | 8/2005 | Akiyama et al. | 318/376 |
| 7,083,392 | B2 * | 8/2006 | Meza et al. | 417/44.2 |
| 7,150,265 | B2 * | 12/2006 | Shibagaki | 123/406.47 |
| 7,375,486 | B2 * | 5/2008 | Ku et al. | 318/599 |
| 7,471,055 | B2 * | 12/2008 | Atmur | 318/400.01 |
| 7,481,045 | B2 * | 1/2009 | Fayard | 60/295 |
| 7,635,253 | B2 * | 12/2009 | Garcia-Ortiz | 417/44.2 |
| 7,821,215 | B2 * | 10/2010 | Koehl | 318/430 |
| 8,019,479 | B2 * | 9/2011 | Stiles et al. | 700/282 |
| 8,024,922 | B2 * | 9/2011 | van Vuuren et al. | 60/286 |
| 2001/0035323 | A1 | 11/2001 | Porter | |
| 2002/0043253 | A1 | 4/2002 | Begley et al. | |
| 2005/0069468 | A1 | 3/2005 | Huber et al. | |
| 2005/0093491 | A1 | 5/2005 | Kruger | |
| 2005/0284448 | A1 * | 12/2005 | Forgue et al. | 123/497 |
| 2006/0120903 | A1 * | 6/2006 | Iwasaki et al. | 417/423.1 |
| 2007/0020108 | A1 * | 1/2007 | Walls | 417/44.2 |
| 2007/0110642 | A1 * | 5/2007 | Hirata | 422/168 |
| 2007/0251502 | A1 * | 11/2007 | Takayanagi et al. | 123/458 |
| 2008/0022659 | A1 * | 1/2008 | Viola et al. | 60/286 |
| 2008/0131291 | A1 * | 6/2008 | Koehl | 417/44.1 |
| 2008/0131296 | A1 * | 6/2008 | Koehl | 417/53 |
| 2008/0148709 | A1 * | 6/2008 | Miller et al. | 60/274 |
| 2008/0163610 | A1 * | 7/2008 | Baird et al. | 60/295 |
| 2009/0096310 | A1 * | 4/2009 | Takeuchi | 310/156.36 |
| 2009/0205316 | A1 * | 8/2009 | Dougnier et al. | 60/274 |
| 2009/0272104 | A1 * | 11/2009 | Garimella et al. | 60/287 |
| 2010/0031639 | A1 * | 2/2010 | Kwon | 60/286 |
| 2010/0139247 | A1 * | 6/2010 | Hiemstra et al. | 60/277 |
| 2010/0139254 | A1 * | 6/2010 | Sebestyen et al. | 60/286 |
| 2010/0199648 | A1 * | 8/2010 | Op De Beeck et al. | 60/303 |
| 2010/0212303 | A1 * | 8/2010 | Jaulmes et al. | 60/303 |
| 2010/0212417 | A1 * | 8/2010 | Crawford et al. | 73/114.76 |
| 2010/0281851 | A1 * | 11/2010 | Roach | 60/274 |
| 2010/0326055 | A1 * | 12/2010 | Huber et al. | 60/286 |
| 2011/0000196 | A1 * | 1/2011 | Kasahara | 60/286 |
| 2011/0079000 | A1 * | 4/2011 | Gouriet et al. | 60/287 |
| 2011/0099983 | A1 * | 5/2011 | Ohno | 60/277 |
| 2011/0146240 | A1 * | 6/2011 | Wilhelm et al. | 60/274 |

FOREIGN PATENT DOCUMENTS

| | | | |
|---|---|---|---|
| EP | 0999298 | A2 | 5/2000 |
| EP | 2047076 | A1 | 4/2009 |
| JP | 2001-342989 | | 12/2001 |
| JP | 2002-44165 | | 2/2002 |
| JP | 2003-254283 | | 9/2003 |
| JP | 2004-509277 | | 3/2004 |
| JP | 2004-151180 | | 5/2004 |
| JP | 2006-020652 | | 1/2006 |
| KR | 20030087810 | A | 11/2003 |

OTHER PUBLICATIONS

Euro IV standard : Directive 98/69/EC of the European Parliament and of the Council of Oct. 13, 1998 relating to measures to be taken against air pollution by emissions from motor vehicles and amending Council Directive 70/220/EEC ( 65 pp.).

Office Action issued Sep. 25, 2012, in Japanese Patent Application No. 2009-545915 (with English-language Translation).

* cited by examiner

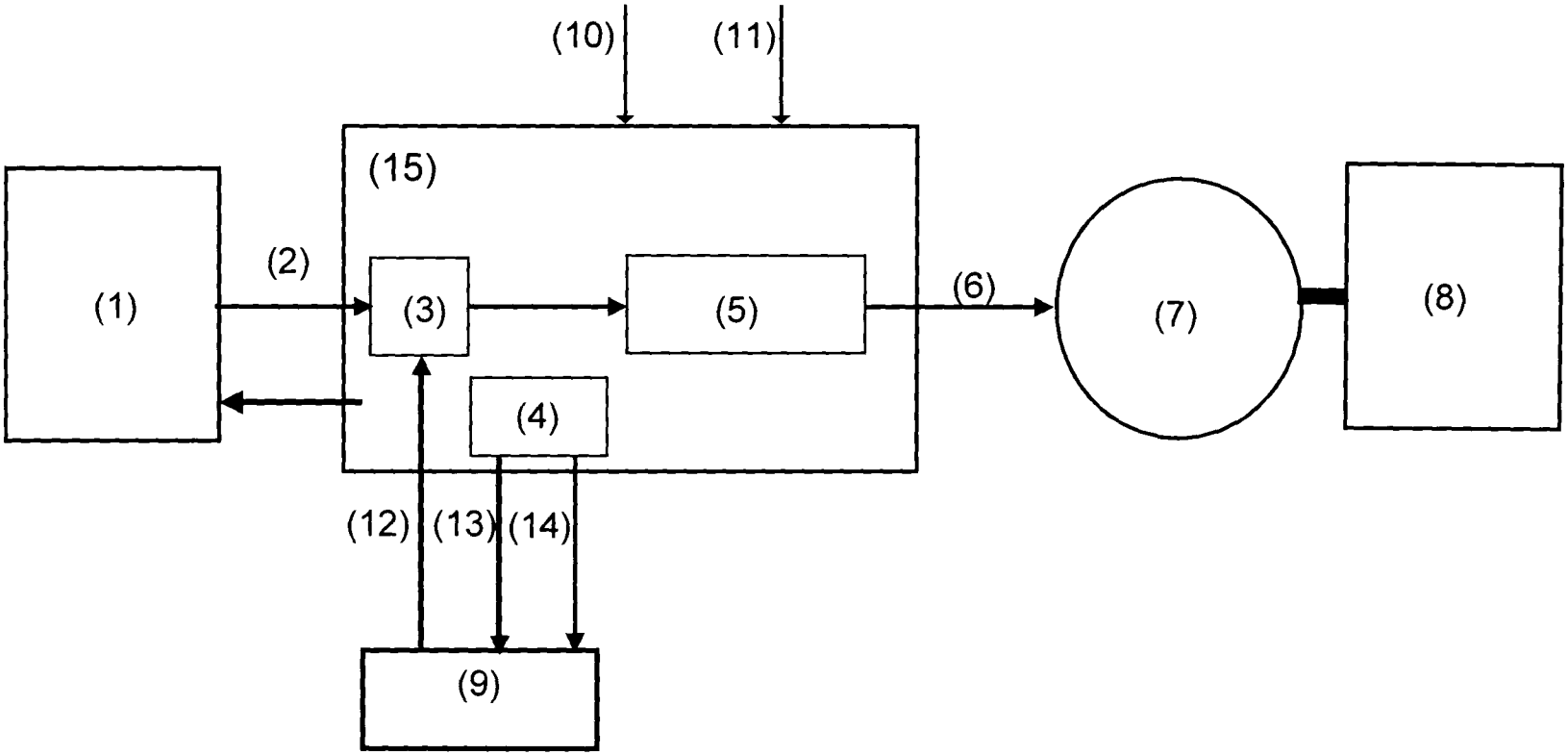
(1)
(2)
(15)
(3)
(4)
(5)
(6)
(7)
(8)
(9)
(10)
(11)
(12)
(13)
(14)

METHOD AND SYSTEM FOR CONTROLLING THE OPERATION OF A PUMP

CROSS-REFERENCE TO RELATED APPLICATIONS

This application is a U.S. national stage application under 35 U.S.C. §371 of International Application No. PCT/EP2008/050435 filed Jan. 16, 2008, which claims priority to French Application No. 0700358 filed Jan. 19, 2007, these applications being incorporated herein by reference in their entirety for all purposes.

BACKGROUND OF THE INVENTION

1. Field of the Invention

The present invention relates to a method for controlling the operation of a pump and also to a system enabling this method to be applied.

With the Euro IV standard on exhaust emissions from heavy goods vehicles coming into effect in 2005, devices for pollution control of NOx (or nitrogen oxides) have had to be put in place.

The system used by most heavy goods vehicle manufacturers for reducing NOx emissions to the required value generally consists in carrying out a selective catalytic reaction with reducing agents such as urea ("Urea SCR" or selective catalytic reduction using ammonia generated in situ in the exhaust gases by decomposition of urea).

In order to do this it is necessary to equip the vehicles with a tank containing a urea solution, a device for metering the amount of urea to be injected into the exhaust line and a device for supplying urea solution to the device for metering the amount of urea to be injected. Generally, the supply device comprises a pump driven by a motor.

Preferably, the operation of this pump is controlled by means of a controller which can act on the operating pressure of the pump, the rotation direction of the pump (either to supply urea, or to purge the conduits), the starting and/or stopping of the pump and/or to carry out a diagnosis of the operating state of the pump.

2. Description of Related Art

In the prior art, several systems have been proposed for controlling the operation of a pump.

Thus, U.S. Pat. No. 5,670,852 describes a device for controlling the speed of an electric motor driving a pump that acts only on the speed of the drive motor, independently of the pressure at the inlet and outlet of the pump. The outlet pressure of the pump is consequently not controlled. The control device regulates the speed of the motor from two input data: a motor speed measurement signal supplied by commutation sensors and a motor speed setpoint signal. The latter is either a voltage or a frequency of a square wave. The control device according to U.S. Pat. No. '852 makes it possible, using a single signal (44), to control all the operating modes of the pump (forward drive, reverse drive). However, it is complex and requires the use of a comparator, a phase-locked (or frequency-locked) loop, commutation comparators, etc. Moreover, it does not make it possible to carry out a diagnosis of the pump operation and, in particular, to identify a risk of explosion in the case where a plug is formed at the pump outlet or a risk of pollution if there is a leak in the supply circuit, since the pressure at the outlet of the pump is not controlled.

Application US 2002/0043253 discloses a system for regulating a pump that makes it possible to solve this problem by directly controlling the pressure at the outlet of the pump. This device comprises a controller (36) which receives a pressure setpoint value from an electronic control module (38), compares this value with that measured by a pressure sensor (30) to create an error signal and generate a modulated (PWM or Pulse Width Modulated) voltage which directly controls the rotational speed of the electric motor. U.S. Pat. No. 5,237,975 describes a similar system.

The system described in these documents is specific to fuel systems, where the electric motor is either running or at rest, but has only one direction of rotation. Especially for the urea pumps mentioned above, it is advantageous to also provide a reverse direction of rotation in order to be able to carry out purge cycles. Moreover, the urea circuits may get blocked up (especially after freezing of the solution) and/or have leaks, in which case the pump is advantageously stopped. However, the system described in the aforementioned documents does not make provision for carrying out a diagnosis on the operation of the pump.

Finally, in the case of systems for the injection of liquid (such as urea) that incorporate a specific control system for the pump, it is necessary to provide an interface between this system and a more central control module (for example that of the vehicle or of a complete injection system) that makes it possible, with the fewest possible electrical connections, to exchange all the information needed for the correct operation of the pump.

BRIEF SUMMARY OF THE INVENTION

The present invention aims to provide a system and a method for controlling the operation of a pump which is simple and nevertheless makes it possible to control the stopping, starting and direction of rotation of said pump at the same time, and also (according to one preferred variant) to provide a diagnosis of correct or poor operation to the electronic control module (ECM) that controls the pump, and all this using a single signal (and therefore a single connection) between the ECM and the pump controller.

BRIEF DESCRIPTION OF THE DRAWINGS

The above and other objects, features and advantages of the invention will become apparent from a consideration of the subsequent detailed description presented in connection with the accompanying drawings, in which:

FIG. 1 shows a system intended for supplying a liquid additive for the exhaust gases of an internal combustion engine according to the present invention.

DETAILED DESCRIPTION OF THE INVENTION

For this purpose, the present invention relates to a method for controlling the operation of a pump driven by an electric motor and controlled by a controller, according to which an ECM sends, to the controller, a PWM (Pulse Width Modulation) control signal having a duty cycle that varies as a function of the desired operating conditions for the pump and according to which the controller acts on the electric motor to apply said operating conditions to the pump.

The method according to the invention may be applied to pumps having various uses. In particular, it may be a pump that enables a liquid to be conveyed from a storage tank to an injection line, and, in order to do this, being connected to the storage tank by a supply line. The method according to the invention gives good results in the context of systems for injecting urea into the exhaust gases of combustion engines.

The pump to which the method according to the invention is applied is a pump of any known type driven by an electric motor (which is preferably specific to it, i.e. which is only used to drive the pump and exercises no other function) and the controller of which is managed by an ECM. Preferably the pump is of the gear pump type. It generally comprises a stator and a rotor and can operate in two opposite rotational directions, one generally corresponding to supplying the supply line with liquid and the other generally corresponding to a purge of the supply line.

Any type of rotary electric motor may be suitable. Preferably, the motor is of the BLDC (brushless direct current) motor type. In this case, the pump is driven by a magnetic coupling between the rotor of the pump and a drive shaft of the motor.

According to the invention, the electric motor is controlled by a controller, i.e. a control module (generally comprising a PID regulator and a motor rotational speed controller) and a power supply unit which supplies the motor with the power required to rotate it at the desired speed and which enables its direction of rotation to be reversed, where necessary.

The pump controller is itself supplied with current either via the ECM, or via a specific current source such as a battery for example. Use of a battery, and in particular a battery supplying 12 V direct current (DC), gives good results.

According to the invention, the pump controller is driven by an ECM which sends it a PWM (Pulse Width Modulation) control signal that includes information relating to the operating conditions of the pump. These conditions are understood to denote information relating to the operating pressure of the pump and also at least one other piece of information such as its stopping/blocking, its rotational direction, etc. They are preferably all the operating conditions of the pump, namely: stopping, forward drive, reverse drive, operating pressure (at the pump outlet), etc. so that the pump operation is entirely conditioned by a single signal. In other words: the controller receives coded instructions (in the form of a PWM signal of variable duty cycle) telling it if it must stop the pump or rotate it forwards, in reverse and at what pressure, which it does by acting on the electric motor, i.e. generally by in turn sending it a voltage signal which may be of PWM type.

The ECM in question in the context of the invention is either an ECM specific to this function, or an ECM capable of also providing other functions and being, for that purpose, capable of also communicating with components other than the pump, for example with temperature and/or pressure sensors, and also of commanding and/or controlling the operation of these components. This ECM may, for example, be specific to an SCR function of a vehicle, or be integrated into the ECM of the internal combustion engine (or ECU=Engine Control Unit).

The PWM signal sent by the ECM is preferably in the form of a square wave, i.e. a train of rectangular pulses having a given duration and amplitude and emitted with a given period. Such a signal (of PWM type) is characterized by its duty cycle, that is to say the ratio of the duration of the pulses to their period.

According to the invention, this signal is variable and conveys information relating to the operating conditions of the pump, namely: stopping, forward drive, reverse drive and operating pressure. The term "variable" is understood to mean that the duty cycle of this signal varies as a function of the desired operating conditions. Preferably, corresponding to one range of duty cycle values is a given operating mode of the electric motor (stopping, starting, forward drive, reverse drive).

Hence, preferably, the controller comprises a memory, in which is stored a lookup table for the duty cycle of the PWM signal emitted by the ECM and the operating mode of the pump. The table may thus equate a $1^{st}$ duty cycle range (I) with a setpoint for stopping the pump; a $2^{nd}$ duty cycle range (II) with a setpoint for forward drive of the pump; and a $3^{rd}$ duty cycle range (III) with a setpoint for reverse drive of the pump.

In order to convey the information relating to the operating pressure, it may be advantageous to use the range (II) to give a linear function of the desired pressure as a function of the duty cycle of the signal. In the case where the pump is intended for an SCR system such as described previously, the reverse drive (in the opposite direction) of the pump is generally intended for the purge which is generally carried out at full flow; in this case therefore, sending a setpoint pressure is not necessary when the pump rotates in reverse. Hence, preferably, the range (II) gives a linear function of the desired pressure as a function of the duty cycle, whereas the range (III) is associated with the maximum speed of the pump motor.

Generally, the PWM signal sent by the ECM is a voltage, and generally a low voltage (5 V or 12 V for example), signal. It may be generated by a control unit, for example the ECU or Engine Control Unit (generally denoting the engine control system of a motor vehicle) or by an ECM specific to the function where the pump is involved (SCR function, for example).

In order to ensure that the pump flows at the operating pressure as quickly and as accurately as possible (or in other words: that the outlet pressure of the pump is rapidly and correctly aligned to the setpoint pressure sent by the ECM), it is advantageous that the controller be connected to a pressure sensor and comprise a pressure regulator and an electric motor rotational speed controller. This makes it possible, in a loop, to compare the pressure setpoint value, where appropriate (i.e. when the pump is running), with the value measured by the sensor and consequently to act on the rotational speed of the motor by means of the rotational speed controller.

Generally, the regulator carries out the comparison between the desired pressure and the pressure measured and generates an error signal for the motor rotational speed controller.

In this variant, the regulator may be of any known type, but it is preferably of PID (Proportional-Integral-Derivative) type. As regards the pressure sensor, it is preferably integrated with the pump, that is to say that it may be attached to the pump by any known attachment means.

According to one preferred variant of the invention, the pump controller may send a pump operation diagnostic signal to the ECM. Generally, this signal corresponds to a voltage. When the pump controller detects an anomaly (via a detector which may be specific to this function and/or via the pressure regulator: see below), the PWM signal may, for example, be earthed by the motor controller, thus causing a short-circuit current which is measured by the ECM and detected as an anomaly condition of the pump operation. Preferably, the controller carries out a diagnosis (detects anomalies) continuously so that the ECM can detect at any moment if there is an anomaly in the pump operation.

A first anomaly in the pump operation may consist of a too high speed of the drive motor (A). The anomaly may be caused by a blockage of the pump by ice, by the fact that the pressure sensor is damaged and indicates a too low pressure; by the presence of a leak downstream of the pump which means that the setpoint pressure cannot be attained, etc. This anomaly may be detected by the regulator which compares the pump outlet pressure with that of the setpoint and may therefore send an anomaly signal when the latter is not attained at the end of a certain time period.

A second anomaly in the pump operation may consist of a too low speed of the motor (B). This anomaly may, for example, be caused by a pressure sensor blocked by freezing at a measured pressure level that is higher than in reality. The controller then receives an indication from the regulator that shows that the pump outlet pressure remains higher than the setpoint pressure and it can communicate this information to the ECM.

A third anomaly in the pump operation may be due to the motor being blocked, resulting in overheating of the latter by an increase in the electric current intensity in the motor (C). This anomaly may be detected by a current sensor integrated into the motor controller.

In a preferred embodiment, the pump is intended to supply a supply line with a liquid additive for the exhaust gases of an internal combustion engine from an additive tank.

Hence, the present invention also relates to a system for supplying a liquid additive for the exhaust gases of an internal combustion engine, said system being equipped with a regulator device capable of applying the method described above and for this purpose comprising:

- a pump enabling said additive to be supplied from a tank into the exhaust gases;
- a rotary electric motor enabling the pump to be driven;
- a controller capable of receiving, from an electronic control module (ECM), a PWM (Pulse Width Modulation) type control signal, of deducing therefrom the operating conditions of the pump and of consequently adapting the speed and/or rotational direction of the motor.

The additive in question within the scope of this variant of the invention is preferably a reducing agent capable of reducing the NOx present in the exhaust gases of internal combustion engines. It is advantageously an ammonia precursor in aqueous solution. The invention gives good results with eutectic solutions of urea for which there is a standard quality: for example, according to the standard DIN 70070, in the case of the AdBlue® solution (commercial solution of urea), the urea content is between 31.8% and 33.2% (by weight) (i.e. 32.5+/−0.7% by weight) hence an available amount of ammonia between 18.0% and 18.8%. The invention may also be applied to the urea/ammonium formate mixtures sold under the trade name Denoxium™ and of which one of the compositions (Denoxium-30) contains an equivalent amount of ammonia to that of the Adblue® solution. The latter have the advantage, with respect to urea, of only freezing from −30° C. onwards (as opposed to −11° C.), but have the disadvantages of corrosion problems linked to the possible release of formic acid.

This variant of the present invention may be applied to any internal combustion engine. It is advantageously applied to diesel engines, and in particular to the diesel engines of heavy goods vehicles.

Preferably, the system according to this variant of the invention is generally also equipped with an injector enabling the additive to be injected into the exhaust gases. This injector may be of any known type. It may, for example, be a so-called "active" injector, that is to say that includes the metering function.

Usually, the system according to the invention comprises a control unit connected to the injector and allowing the required amount of additive to be injected into the exhaust gases (the amount being dependent in particular on the following parameters: emission level and degree of conversion of the NOx; temperature and pressure; engine speed and load, etc. and, optionally, the quality (state of ageing) of the solution).

In certain cases, the entire additive flow provided by the pump is not injected into the exhaust gases and the uninjected part must then be recirculated. Such an excess flow may be used to cool certain types of "active" injectors (such as that described in application U.S. Pat. No. 5,976,475 for example). It may also be necessary for accurate metering control as in the system described in Application FR 06/06425 in the name of the Applicant and which involves the use of a metering valve and a pressure regulator.

For the reasons explained above, it may be advantageous to provide the system according to this aspect of the invention with at least one of the following components:

- a pressure sensor that makes it possible to check that the setpoint pressure is attained;
- a PID regulator of the requested pressure;
- an electric motor speed controller;
- a diagnostic circuit enabling a diagnostic signal relating to the pump operation to be sent to the ECM.

Similarly, all the other characteristics presented as advantageous within the context of the description of the method according to the invention are also so within the context of the system according to the invention and, in particular, when it is an SCR system.

The present invention is illustrated, in a non-limiting manner, by FIG. 1.

The latter represents an advantageous variant of a system according to the invention intended for injecting a urea solution into the exhaust gases of a diesel vehicle.

It illustrates a block diagram of the control system of a urea pump (8) driven by a BLDC motor (7) and which is controlled by a controller (15). The controller (15) comprises a PID regulator (3), a motor rotational speed controller (5) and an electric power supply unit (4). The controller (15) itself has a 12 V DC power supply (10) and earthing (11). The controller (15) receives, from an ECM (1), a PWM signal (2)—an example of which will be described in more detail hereinbelow. The controller (15) then sends back, to the ECM (1), a diagnostic signal of the operating state of the pump (8). It also receives, as an input signal, a signal of the pressure (12) measured by a pressure sensor (9) which is supplied with power by the power supply unit (4) through a signal (13) and an earth (14). Control of the rotational speed of the motor (7) is achieved by sending, to the motor (7), a given voltage (6) which may also be in the form of a PWM voltage so that the outlet pressure of the pump (8) follows the setpoint conveyed by the control signal (2).

An example of a PWM signal which may be emitted by the ECM is a train of rectangular pulses emitted at a frequency of 1 kHz, with a voltage of 12 V and a current of 50 mA.

According to the invention, this wave train has a duty cycle that varies according to the operating conditions of the pump.

Thus, in the example in question:

- corresponding to duty cycles between 0 and 10% or between 90 and 100% is a setpoint for stopping the pump;
- during normal operation (forward drive), the duty cycle is set at a value between 20 and 90%, knowing that corresponding to a value of 20% is a pressure of 1 bar and that this varies linearly to reach 8 bar (maximum pressure in this example) at 90% of duty cycle; and
- corresponding to a duty cycle between 10 and 20% is the reverse operation of the pump at maximum motor speed so as to be able to purge an SCR system.

In this example, in order to carry out a purge cycle, the ECM emits a PWM signal, the duty cycle of which has a value of between 0 and 10%, for 500 ms (to stop the pump); next, it changes the duty cycle of the signal to set it to a value between 10 and 20% and cause the purge. The duration of the purge (and therefore: the duration of the period during which the PWM signal has a value between 10 and 20%) depends on the configuration of the system to be purged. This duration is typically from 10 s to 1 min for SCR systems. Finally, the ECM modifies the duty cycle of the PWM one last time and sets it to a value between 0 and 10% to stop the pump again.

REFERENCE SIGNS OF THE FIGURES (1) ECM
(2) PWM signal emitted by the ECM
(3) PID regulator
(4) power supply unit
(5) motor controller
(6) motor supply voltage
(7) motor
(8) pump
(9) pressure sensor
(10) power supply
(11) earth
(12) pressure sensor signal
(13) pressure sensor power supply
(14) pressure sensor earth
(15) controller of the pump which encompasses (3), (4) and (5)

The invention claimed is:

1. A method for controlling an operation of a pump of a system that supplies a liquid additive for exhaust gases of an internal combustion engine, said pump driven in two opposite rotational directions by an electric motor and controlled by a controller, according to which an electronic control module (ECM) sends, to the controller, a pulse width modulation control signal having a variable duty cycle and according to which the controller acts on the electric motor to apply desired operating conditions to the pump, wherein each duty cycle of the pulse width modulation control signal is associated to a plurality of information relative to said operating conditions of the pump, the plurality of information comprising at least one information relative to a desired output pressure of the pump and one information relative to a desired rotational direction of the pump, wherein corresponding to a first duty cycle range (I) is a setpoint for stopping the pump, corresponding to a second duty cycle range (II) is a setpoint for forward drive of the pump, and corresponding to a third duty cycle range (III) is a setpoint for reverse drive of the pump, and wherein during a purge cycle, the electronic control module emits the pulse width modulation control signal with a duty cycle value in the first duty cycle range to stop the pump, changes the duty cycle value to a value in the third duty cycle range to cause the purge, and changes the duty cycle value to a value in the first duty cycle range to stop the pump again.

2. The method according to claim 1, wherein the electric motor is of a brushless direct current or BLDC motor type.

3. The method according to claim 1, wherein the pulse width modulation control signal is in a form of a square wave.

4. The method according to claim 1, wherein: in the first duty cycle range (I) the setpoint for stopping the pump is between 0 and 10% or between 90 and 100%, in the second duty cycle range (II) the setpoint for forward drive of the pump is between 20 and 90%, and in the third duty cycle range (III) the setpoint for reverse drive of the pump is between 10 and 20%.

5. The method according to claim 4, wherein the range (II) gives a linear function of the desired pressure as a function of the duty cycle.

6. The method according to claim 5, wherein the controller is connected to a pressure sensor and comprises a pressure regulator and an electric motor rotational speed controller; and wherein, in a loop, the controller compares a pressure setpoint value with a value measured by the sensor and consequently acts on a rotational speed of the electric motor by means of the rotational speed controller.

7. The method according to claim 6, wherein the regulator is of PID (Proportional-Integral-Derivative) type and wherein the regulator generates an error signal for the electric motor rotational speed controller.

8. The method according to claim 1, wherein the pump controller sends a pump operation diagnostic signal to the ECM by continuously detecting operating anomalies of the pump using a detector and earthing the pulse width modulation control signal when such a signal is detected.

9. A system for supplying a liquid additive for exhaust gases of an internal combustion engine, said system comprising:

a pump enabling said additive to be supplied from a tank into the exhaust gases;

a rotary electric motor enabling the pump to be driven in two opposite rotational directions; and a controller configured to receive, from an electronic control module (ECM), a pulse width modulation control signal, to determine from a duty cycle a plurality of information relative to operating conditions of the pump and to consequently adapt a speed and/or a rotational direction of the electric motor, wherein corresponding to a first duty cycle range (I) is a setpoint for stopping the pump, corresponding to a second duty cycle range (II) is a setpoint for forward drive of the pump, and corresponding to a third duty cycle range (III) is a setpoint for reverse drive of the pump, and wherein during a purge cycle, the electronic control module emits the pulse width modulation control signal with a duty cycle value in the first duty cycle range to stop the pump, changes the duty cycle value to a value in the third duty cycle range to cause the purge, and changes the duty cycle value to a value in the first duty cycle range to stop the pump again.

10. The system according to claim 9, comprising at least one of the following components selected from a group consisting of: a pressure sensor; a PID (Proportional-Integral-Derivative) regulator; an electric motor speed controller; and a diagnostic circuit enabling a diagnostic signal relating to the pump operation to be sent to the ECM.

11. The system according to claim 9, wherein the liquid additive is an ammonia precursor reducing agent in an aqueous solution.

12. The method according to claim 1, wherein the first set of pump operating conditions corresponds to the pump being stopped.

13. The method according to claim 1, wherein the second set of pump operating conditions corresponds to the pump in forward drive.

14. The method according to claim 1, wherein the third set of pump operating conditions corresponds to the pump in reverse drive.

15. The method according to claim 8, wherein for speed anomalies of the pump a pressure regulator compares a pump outlet pressure with a pump setpoint pressure and reports anomalies to the controller.

16. The system according to claim 9, wherein the speed and/or rotational direction of the electric motor are adapted according to a lookup table for the duty cycle and the operating conditions of the pump stored in a memory of the controller, wherein duty cycles between 0% and 10% and duty cycles between 90% and 100% correspond to a first set of pump operating conditions, wherein duty cycles between 20% and 90% correspond to a second set of pump operating conditions, and wherein duty cycles between 10% and 20% correspond to a third set of pump operating conditions.

* * * * *